United States Patent [19]

Stiltz et al.

[11] 3,998,278

[45] Dec. 21, 1976

[54] HAMMER DRILL

[75] Inventors: Erwin Stiltz, Winnenden-Schelmenholz; Rudolf Hoyer, Winnenden, both of Germany

[73] Assignee: Licentia Patent-Verwaltungs-G.m.b.H., Frankfurt am Main, Germany

[22] Filed: May 13, 1975

[21] Appl. No.: 577,086

[30] Foreign Application Priority Data

May 14, 1974 Germany ..... 2423332

[52] U.S. Cl. ..... 173/13; 173/48; 173/109

[51] Int. Cl.[2] ..... E21C 1/12

[58] Field of Search ..... 173/13, 48, 109

[56] References Cited

UNITED STATES PATENTS 3,685,594 8/1972 Koehler ..... 173/109 X

FOREIGN PATENTS OR APPLICATIONS 2,029,614 12/1971 Germany ..... 173/48

*Primary Examiner*—Ernest R. Purser
*Attorney, Agent, or Firm*—Spencer & Kaye

[57] ABSTRACT

A hammer drill has a housing, a tool shaft rotatably and axially displaceably supported in the housing, a motor, a gearing connecting the motor with the tool shaft and a striking mechanism for imparting successive impacts to the tool shaft. The striking mechanism includes an axially movable striking element. The hammer drill further has a clutch component mounted on the tool shaft and having an engaged state in which it is operatively connected to the striking element and a disengaged state in which it is disconnected from the striking element, and a drive element connecting the motor with the clutch component to rotate the latter. The drive element and the clutch component are arranged axially slidably relative to one another. The striking mechanism further has an intermediate member supported next to and in axial alignment with the clutch component. The intermediate member has coupling elements operatively connected to the clutch component in the engaged state of the clutch component in which the striking mechanism is in an operating state. The coupling elements are disconnected from the clutch component in the disengaged state of the clutch component in which the striking mechanism is in a non-operating state. The intermediate member at least partially surrounds the striking element for guiding the same in its axial motion. The tool shaft has an inner terminus which is positioned externally of the outline of the striking mechanism.

11 Claims, 2 Drawing Figures

HAMMER DRILL

BACKGROUND OF THE INVENTION

Hammer drills are known which have an intermediate member provided with coupling jaws and cam faces and a striking mechanism formed of a striking element which has follower cam faces and which is biased by a resetting force. The striking mechanism is actuatable by means of a clutch component which is disposed on the tool shaft and which is provided with jaws that cooperate with corresonding coupling jaws of the intermediate member. The clutch component is rotated by means of a drive element.

The actuation of the striking mechanism is effected when the hammer drill is placed against the object to be worked and the tool shaft is axially pressed inwardly. As a result, the jaws of the clutch part on the tool shaft engage the counterjaws of the intermediate member. As the intermediate member rotates by virtue of the engaged state of the clutch component, the abruptly terminating cam faces of the intermediate member repeatedly lift the striking element against the force of a striking (compression) spring and then allow the striking element, propelled by the compression spring, to axially impact the tool shaft. Such a device is disclosed in German Laid-Open Patent Application (Offenlegungsschrift) No. 2,203,072.

A driving stage and a striking mechanism structured as outlined above are disadvantageous in that the tool shaft extends through the intermediate member into the interior of the striking element which in this region has the shape of a hollow cylinder. Consequently, the intermediate member must be mounted in a bearing on the tool shaft and thus friction losses occur even when the tool is used merely as a drill, since the tool shaft moves relative to the intermediate member. Furthermore, in the hammer drill drive of the above structure, the coupling part disposed on the tool shaft is, at the same time, a gear, so that the mass of the rotating and/or axially vibrating tool shaft is unnecessarily large for its purpose. Furthermore, the tool shaft which extends relatively far into the interior of the tool has an adverse effect on the structural length of the tool, on the diameter of the striking mechanism and thus on the entire hammer drill.

SUMMARY OF THE INVENTION

It is an object of the present invention to provide an improved hammer drill which is superior to the known structures with respect to friction losses, spatial requirements, mass of the tool shaft and lubrication and which can also be used merely as a drill for home use and is suited to accommodate accessories and adapters.

This object and others to become apparent as the specification progresses are accomplished by the invention, according to which, briefly stated, the drive element and the clutch component are arranged axially slidably relative to one another; the intermediate member at least partially surrounds the striking element for guiding the same in its axial motion. The tool shaft has an inner terminus positioned externally of the outline of the striking mechanism.

It has been found to be particularly advantageous to effect the axial displacement between the element driving the clutch part and the clutch part itself by designing the element as a toothed gear and the clutch part as a splined shaft.

DESCRIPTION OF THE PREFERRED EMBODIMENT

Figures 1, 2:
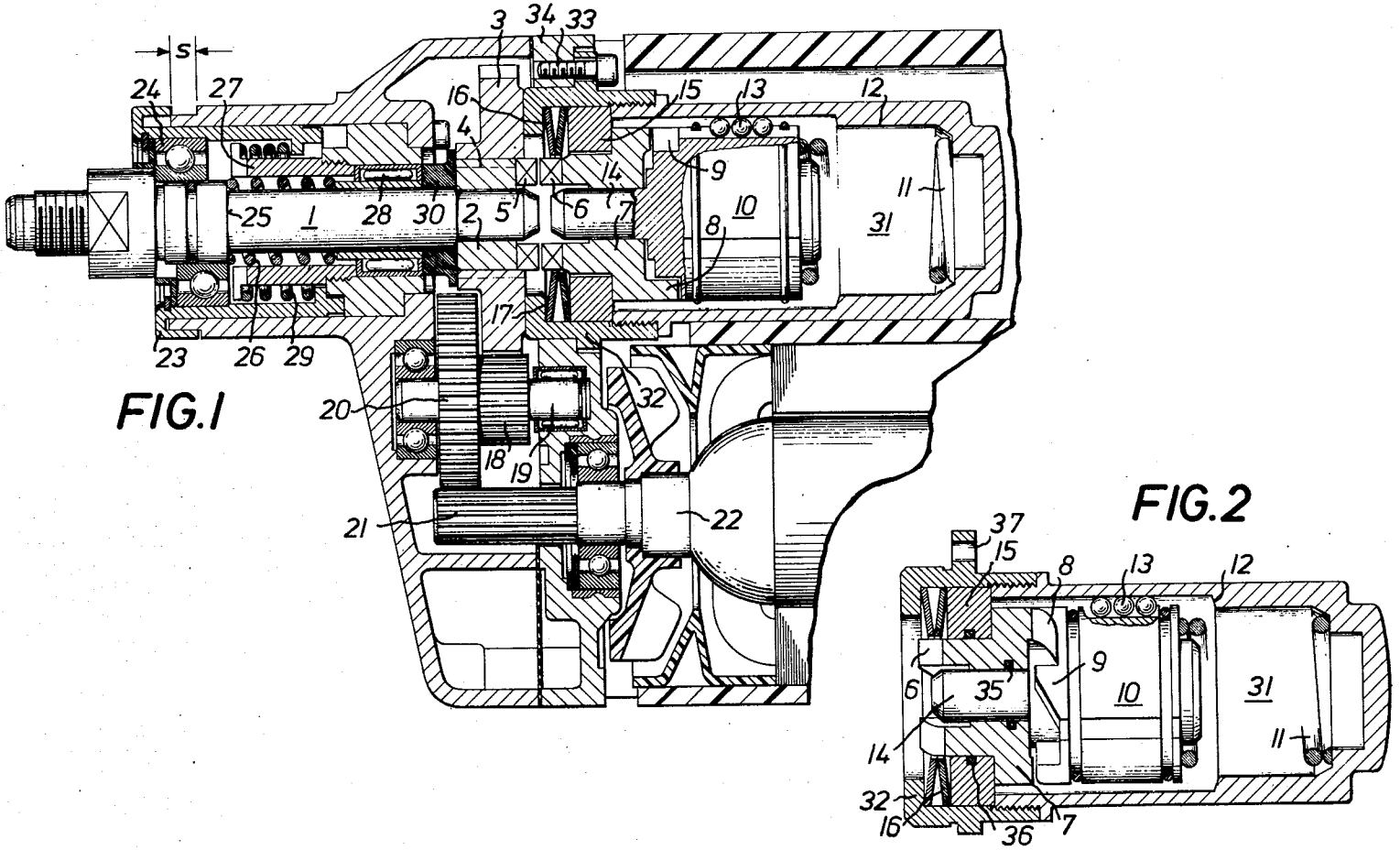
FIG. 1 is a fragmentary longitudinal sectional view of a hammer drill incorporating a preferred embodiment of the invention.
FIG. 2 is a longitudinal sectional view of a detail of FIG. 1.

Turning now to FIG. 1, a clutch part 2 is fixedly attached to a tool shaft 1 and is in a force-transmitting connection with an associated drive element (gear) 3 by means of a splined shaft gear 4. The latter permits a relative displacement of the clutch part 2 with respect to the gear 3 in the axial direction. The clutch part 2 includes jaws 5 which cooperate with coupling jaws 6 of an intermediate member 7. The intermediate member 7 is provided with ratchet-like cam faces 8 at its end facing away from the jaws 6. The cam faces 8 are in engagement with follower cam faces 9 of a striking element 10 which has a spring 11 acting on the rear radial face of the striking element 10. The latter and the spring 11 are guided or accommodated, respectively, in a housing 12. The striking element 10 is secured against rotation by means of balls 13 which ensure minimum friction. The intermediate member 7 has, in its region facing away from the cam faces 8, a reduced outer diameter and is designed to act as an auxiliary guide for a pin-shaped part 14 of the striking element 10. As may be further seen in FIG. 1, according to the invention the tool shaft 1 has, within the hammer drill housing, a terminus which lies externally of the outline of the striking mechanism that includes the intermediate member 7 and the striking element 10. Stated differently, the tool shaft 1 is mechanically separated from the tool shaft striking mechanism.

The above-described design of the intermediate member 7 also assures sealing of the lubricant chamber 31 on the side of the striking element. Moreover, the slide-and-thrust bearing 15 is inserted on the portion of reduced thickness of the intermediate member 7. The bearing 15 is urged into contact by means of cup springs 16 or the like, with a frontal wall 17 of a striker housing 12 which is widened at this location. The cup springs 16 act as damping members.

The toothed gear 3 which meshes with the splined shaft gear 4 of the clutch part 2 is driven by an intermediate gear 18 which is disposed on shaft 19. On the latter there is also mounted a gear 20 which meshes with a pinion stub 21 of a drive shaft 22.

The hammer drill according to the present invention can be switched to a "drilling mode" or to a "hammer drilling mode" by means of a setting ring 23. When the setting ring 23 which accommodates the outer race of a bearing 24 for the tool shaft 1 is actuated (rotated) in its illustrated position, the bearing 24, together with the setting ring 23 which has suitably pitched cam faces or the like, is shifted towards the right, that is, towards the interior of the machine by the distance *s*. Thus, the tool shaft 1 which had no play before, now has an axial play *s* so that it can also be displaced into the interior of the machine against the force of spring 26. It is noted that the clearance *s* will appear between the forwardly oriented radial face of the inner race of the bearing 24 and the rearwardly oriented radial face of a collar forming part of the tool shaft 1. When the tool bit, attached to the forward end of the tool shaft 1, for example, by means of a chuck, is placed against the object to be worked on, and there is exerted an external axial force on the tool shaft 1, the latter is displaced towards the interior of the machine against the force of the spring 26 until the jaws 5 of the clutch part 2 disposed on the tool shaft 1 arrive into engagement with the coupling jaws 6 of the intermediate member 7. The spring 26 which is radially confined by a sleeve 27, has a front terminus which engages a collar 25 of the tool shaft 1 and a rear terminus which is supported by the sleeve of a needle bearing 28. The interengagement between jaws 5 and 6 causes the member 7 to be rotated and thus, the striking mechanism begins to operate in a known manner.

When the setting ring 23 is in its forward position as illustrated in FIG. 1, the bearing 24 is also in its axially forward position and thus an axial inward shift of the tool shaft 1 is blocked. Consequently, the jaws 5 of the clutch component 2 cannot be brought into engagement with the jaws 6 of the intermediate member 7 and thus, as a result, the striking mechanism cannot operate. In such cases the tool shaft will be merely rotated by the torque transmitted by components 22, 21, 20, 3, 4 and 17.

A further spring 29 may be provided between the setting ring 23 and the sleeve 27. An abutment ring 30 surrounds the tool shaft 1 and engages the needle bearing sleeve and a conical part which is screwed to sleeve 27 and which accommodates the needles of the needle bearing. Hammer drills according to the present invention are particularly advantageous if the drive housing including the tool shaft are designed so that they are suited to accommodate already available accessories and adapters. It is further expedient to provide the hammer drill with a speed control arrangement.

Turning now to FIG. 2, there is separately illustrated the striking mechanism comprising the striking element 10 which is secured against rotation in the housing 12 by means of balls 13 and which includes the pin-shaped part 14 and the follower cam faces 9; the compression spring 11; the intermediate member 7 with its coupling jaws 6 and the cam faces 8; the thrust bearing 15; the cup springs 16; and a screw cap 32. As may be observed in FIG. 1, the striking mechanism is interchangeably fastened to an intermediate flange 34 of the hammer drill housing by means of screws 33. For this purpose the screw cap 32 is provided with fastening eyes 37.

O-rings 35 and 36 are provided, respectively, between the pin-shaped part 14 of the striking element 10 and the intermediate member 7 and between the thrust bearing 15 and the outer contour of the intermediate member 7. The purpose of the O-rings 35 and 36 is to prevent leakage of lubricant from the lubricant chamber 31 into the housing space that accommodates the tool shaft drive.

It will be understood that the above description of the present invention is susceptible to various modifications, changes and adaptations, and the same are intended to be comprehended within the meaning and range of equivalents of the appended claims.

What is claimed is:

1. In a hammer drill including a housing; a tool shaft rotatably and axially displaceably supported in the housing; power means; gearing means connecting the power means with the tool shaft; a striking mechanism for imparting successive impacts to the tool shaft, the striking mechanism including an axially movable striking element and an intermediate member coupled to the striking element for operating the latter; a drive element driven by the power means; and a clutch component mounted on the tool shaft and having an engaged state in which it operatively couples the drive element to the intermediate member whereby the striking mechanism is in an operating state, the clutch component having a disengaged state in which the drive element is disengaged from the intermediate member whereby the striking mechanism is in a non-operating state; the improvement wherein said drive element and said clutch component are arranged axially slidably relative to one another; said intermediate member at least partially surrounding said striking element for guiding the same in its axial motion; said tool shaft having a terminus within said housing, said terminus being positioned externally of the outline of said striking mechanism.

2. A hammer drill as defined in claim 1, wherein said drive element is a drive gear axially immovably supported in said housing.

3. A hammer drill as defined in claim 2, said drive gear being disposed coaxially with respect to said tool shaft.

4. A hammer drill as defined in claim 3, said drive gear having outer teeth meshing with an element of said gearing means; said drive gear coaxially surrounding said clutch component and being permanently coupled thereto for transmitting torque from said drive gear to said clutch component.

5. A hammer drill as defined in claim 4, wherein the torque-transmitting connection between said drive gear and said clutch component is effected by a spline coupling between said drive gear and said clutch component.

6. A hammer drill as defined in claim 1, further comprising means defining a lubricant chamber in communication with said striking mechanism; said intermediate member sealing said lubricant chamber from a housing space in which said gearing means, said drive means and said clutch component are disposed.

7. A hammer drill as defined in claim 1, wherein said clutch component is rigidly affixed to said tool shaft to move therewith as a unit; said tool shaft having an axially forward position in which said clutch component is in its said disengaged state and an axially rearward position in which said clutch component is in its said engaged state.

8. A hammer drill as defined in claim 7, further comprising a manually operable setting member supported by said housing and cooperating with said tool shaft, said setting member having a first position preventing said tool shaft from being displaced from its said axially forward position to its said axially rearward position; said setting member having a second position permitting said tool shaft to be displaced, by external axial forces, from its said axially forward position to its said axially rearward position.

9. A hammer drill as defined in claim 1, further comprising a striker housing accommodating said striking mechanism; a screw cap member attached to said striker housing; and means detachably securing said screw cap member to said housing for removal from and insertion into said housing of said striker housing, said striking mechanism and said screw cap member as a unit.

10. A hammer drill as defined in claim 1, said striking element having an integral striking pin oriented axially toward said terminus of said tool shaft; said striking pin being surrounded by said intermediate member; the improvement further comprising a slide-and-thrust bearing surrounding and supporting said intermediate member; first circumferential sealing means provided between said striking pin and said intermediate member; and second circumferential sealing means provided between said bearing and said intermediate member.

11. A hammer drill as defined in claim 1, wherein said clutch component is coaxially surrounded by said drive element; said drive element being in continuous torque-transmitting relationship with said clutch component and said clutch component being fixedly attached to said tool shaft.

* * * * *